US009038926B2

(12) United States Patent
Smith

(10) Patent No.: US 9,038,926 B2
(45) Date of Patent: May 26, 2015

(54) ATTACHMENT TO IMPROVE TRANSFER EFFICIENCY FOR A SPRAYING DEVICE

(71) Applicant: William C. Smith, Upland, CA (US)

(72) Inventor: William C. Smith, Upland, CA (US)

( * ) Notice: Subject to any disclaimer, the term of this patent is extended or adjusted under 35 U.S.C. 154(b) by 0 days.

(21) Appl. No.: 14/467,141

(22) Filed: Aug. 25, 2014

(65) Prior Publication Data

US 2015/0097060 A1 Apr. 9, 2015

Related U.S. Application Data

(60) Provisional application No. 61/960,999, filed on Oct. 3, 2013.

(51) Int. Cl.

| | |
|---|---|
| ***B05B 1/28*** | (2006.01) |
| ***B05B 7/08*** | (2006.01) |
| ***B05B 7/06*** | (2006.01) |
| *B05B 15/04* | (2006.01) |

(52) U.S. Cl.

CPC ..... *B05B 7/0861* (2013.01); *B05B 7/0815* (2013.01); *B05B 7/066* (2013.01); *B05B 15/0431* (2013.01)

(58) Field of Classification Search

CPC .. B05B 7/0433; B05B 7/0815; B05B 7/0846; B05B 7/0892; B05B 7/066; B05B 15/0431; B05B 7/861

USPC ..... 239/290, 292, 296, 298, 419.5, 423, 239/424, 425.5, 704, 705, 708

See application file for complete search history.

(56) References Cited

U.S. PATENT DOCUMENTS

| | | | | |
|---|---|---|---|---|
| 4,767,056 | A * | 8/1988 | Demetrius et al. | 239/288 |
| 5,011,086 | A * | 4/1991 | Sonnleitner et al. | 239/691 |
| 6,006,999 | A * | 12/1999 | Tiessen et al. | 239/3 |
| 6,135,365 | A * | 10/2000 | Kuwahara | 239/296 |

* cited by examiner

*Primary Examiner* — Dinh Q Nguyen

(74) *Attorney, Agent, or Firm* — Thomas Hamill, Jr.; Robert M. Schwartz

(57) ABSTRACT

An attachment to be employed with any spray device is disclosed. The attachment includes four vanes which are radially attached to an air hub with a central aperture, the central aperture adapted to receive the front portion of the spray device therethrough which when activated dispenses an atomizable substance in a pattern toward a workpiece. At the distal end of each of the four vanes, the vane is angled forward such that it generally points toward the workpiece. At the terminal end of each vane is a plurality of compressed air exit apertures. A compressed air source is attached to the air hub which guides the air through air conduits interiorly disposed within each of the vanes, where the compressed air is forced to exit each of the compressed air exit apertures forming an a second pattern which surrounds the atomizable substance pattern, and further boosts or pushes the atomizable substance onto the workpiece. The second pattern reduces overspray, bounce-back, and errant particles, and improves the transfer efficiency.

22 Claims, 12 Drawing Sheets

ATTACHMENT TO IMPROVE TRANSFER EFFICIENCY FOR A SPRAYING DEVICE

CROSS-REFERENCE TO RELATED APPLICATIONS

This application claims the benefit of U.S. Provisional Application Ser. No. 61/960,999 entitled "Re-energizing a Spray Pattern Downstream" filed on Oct. 3, 2013, the prior application is herewith incorporated by reference in its entirety.

BACKGROUND OF THE INVENTION

Current spray atomizers employed in coating a workpiece have several drawbacks which impair their ability to transfer the atomized coating to the workpiece. These include, but are not limited to, a loss of energy as the atomized particle travels from the spray device to the workpiece, overspray, errant particles of multiple sizes, and a bounce-back effect from the workpiece.

When a pattern of coating leaves a spraying device it passes through several stages. The first stage is the atomization of the coating, the second stage is the shaping of a of a spray pattern, such as a fan pattern, by pattern shaping devices located on the front portion of the spraying device. The atomization of the coating does not produce a plethora of uniform coating particle sizes, but a distribution of larger sized coating particles, medium sized coating particles, all the way to micron sized coating particles. After the atomized coating has left the region proximal the nozzle and moves toward the workpiece, the coating experiences the effect of decompression, which causes a portion of the atomized particles of the coating to stray from the main pattern and become errant. These errant coating particles are very small and are not affected by gravity, they literally float in the air proximal the spray. This decompression region in the spray pattern is problematic in that it includes particles that are less than 10 microns in size. Without safety measures a particle of such a size can easily infiltrate the lungs and be retained therein. Due to the nature of many coatings, be they toxic or non-toxic, the infiltration of such particles into the lung is highly undesirable. Although the compressed air is the primary driver of the coating to the workpiece, it is also this pressure which causes the decompression which in turn is one of the major factors in the creation of overspray. As the coating travels farther from the nozzle toward the workpiece, the energy of the pattern begins to lose it's frictional bond and deplete. When the coating reaches the target workpiece, it experiences bounce-back when over-energized or not controlled by some other means.

In the process described, the percentage of the coating that it actually delivered to the workpiece, known as Transfer Efficiency (TE) is relatively low. The closer the nozzle is to the workpiece, a higher transfer efficiency (TE) may be achieved; however, this must be done with the appropriate amount of energy moving the atomized coating particles through the atmosphere between the spray device and the workpiece. At a constant air pressure moving the atomized coating, if the nozzle is too close to the workpiece, it will cause more bounce back as well as running of the coating on the workpiece. Alternatively, if the nozzle is too far away from the workpiece, insufficient atomized coating will be able to travel the distance. Both of these scenarios have a negative impact on the transfer efficiency as well as the quality of the coating on the workpiece.

A skilled and experienced operator would find a sweet spot for maximum transfer efficiency, by adjusting the distance of the spray device to the workpiece, adjusting the level of pressurized air moving the atomized coating toward the workpiece, as well as other tricks of the trade. However, even at this sweet spot, the generation of overspray, microscopic errant particles, bounce-back and other factors give an upper limit to the transfer efficiency. Over 50% of material sprayed by a spray device is lost to the above named factors combined with other factors. Even if the overspray is collected and the errant particles corralled, it may help the environment but does not put any more coating on the workpiece.

What is required is a device which will energize the coating particles in the spray pattern leaving the spray device while in flight to the workpiece, this additional energy coming in the form of a controlled pattern of additional compressed air. This additional compressed air would come from an attachment which would mount on the front portion of the spray device. The attachment would have a second supply of compressed air which would enter an air hub. Depending from the outer sidewall of the air hub are four (4) vanes which are located about 90° to each other. Two of these vanes have a first length and two of these vanes have a second length.

Insofar as this invention is concerned, compressed air is not limited solely to compressed atmospheric air. Below follows a list of the mixture of gases which are found in atmospheric air.

| Components of Atmospheric Air by Molar Percent | |
|---|---|
| Nitrogen | 78.084% |
| Oxygen | 20.994% |
| Argon | 0.934% |
| Carbon Dioxide | 0.035% |
| Neon | 0.001818% |
| Helium | 0.000524% |
| Methane | 0.00017% |
| Krypton | 0.000114% |
| Hydrogen | 0.000053% |
| Nitrous Oxide | 0.000031% |

In addition Ozone, Carbon Monoxide, Sulfur Dioxide and Ammonia are present in atmospheric air in trace quantities.

It has been considered that the instant invention may be utilized with gasses or combination of gasses which are different than atmospheric air. These gasses and mixtures of gasses are would be compressed and utilized just as compressed air would be. In this application, the term compressed air includes compressed gasses and mixtures of gasses. Further, the term air in this application includes gas or mixture of gasses. For simplicity, the airhub 60 will allow the flow of not just air, but any gas, mixture of gas or microscopic elements which may be entrained therein. It will not be referred to as the gashub, rather as an airhub. The same follows for air passageways and air conduits.

All four of the vanes have an internal air passageway which permits the secondary compressed air to flow to the distal end of each of the four vanes. At the distal end of each of the four vanes, is a canted or angled vane element which also includes an internal compressed air passageway therein which is in communication with the internal air passageway of the four vanes. The distal end of each of the four vanes are canted or angled toward the workpiece. The secondary compressed air passageway which is located in the canted or angled portion of the four vanes each have a secondary compressed air exit, the secondary compressed air exit comprised of a plurality of apertures. The plurality of apertures located at the secondary compressed air exit aims the secondary compressed air flow or second pattern into and about the first spray pattern of atomized coating particles traveling toward the workpiece, thus adding a boost of energy to the spray pattern. The boost of energy when added to the spray pattern encourages the atomized coating particles to hit and adhere to the workpiece. Additionally, the secondary compressed air flow leaving the attachment creates an directional flow of energy peripherally, which surrounds the pattern, corralling the atomized particles back into the spray pattern.

The spray attachment has the advantage which permits it's use with existing spraying devices and requires no special training for the operator. The spray attachment may be manufactured with different vane lengths as well as different canting angles at the distal end of the vanes giving the spray attachment the ability to be used with pre-existing atomizing spray devices. Additionally, the spray attachment may be used with, but is not limited to, any and all coatings, fluids, adhesives, paints, anti-corrosive agents, insecticides, herbicides, pesticides, waxes, fungicides and the like, which are currently employed to coat or be delivered to a workpiece or target area by a spray device. Such a device can be used by, but is not limited to use by, a human operator, a numerically controlled spray machine, a robotic spray device or the like. Such a device would substantially and measurably increase the transfer efficiency of the coating on the workpiece.

It is also noted that the invention can be employed with any spraying device. Additionally, the invention can be employed with airless atomization tools or air assisted airless atomization tools. Still, compressed air would be employed through the air pathways created by the invention when using such atomization spray devices.

The vane length is dependent on the nozzle of the spraying device which is employed with the invention. As different nozzles produce different spray patterns, the vanes will need to be adjusted in length accordingly in order to produce an air pattern which will add the boost or push to whatever may be spraying through the nozzle to increase the transfer efficiency to the target or workpiece.

The spray attachment will be discussed in further detail in the description in the Summary of the Invention and the Detailed Description of the Figures.

It to be understood that although the Figures show a conventional hand held spray gun, the invention is in absolutely no way limited to such a device. It may be employed with spray nozzles of any type, be they operated by humans, robots or machines, for cleaning, coating, cooling, drying, lubricating, dispensing, sanitizing, marking or other industrial processes and the like.

SUMMARY OF THE INVENTION

The invention is an attachment for an atomizing spray device, other types of spray devices, or other spraying devices. A cylindrical air hub with a central aperture is provided to permit the front portion of the spray device or nozzle to be securely mounted through the central aperture.

The central aperture of the air hub is adapted to receive the front of the spray device there-through. The interior portion of a cylindrical sidewall securely surrounds the front portion of the spray device, this front portion of the spray device generally would include a center-point where the workpiece coating material is atomized, and proximal to the center-point resides a pair of air horns. For purposes of clarification, the spray device does not form any part of the invention. The spray device is to be used in conjunction with the spray device attachment, which is the invention.

The cylindrical air hub with a central aperture has a front ring with a first interior air passage and a rear ring with a second interior air passage which are separated by an interior dividing wall. The interior dividing wall divides the cylindrical air hub in half which results in the first interior air passage and the second interior passage being of the same size as well as being parallel to each other.

A bifurcated compressed air port passes through the sidewall of the air hub. The bifurcated compressed air port has a dividing element. The bifurcated compressed air port is attached to the air hub in such a fashion that the dividing element is in the same plane and connected to the dividing wall which separates the first interior air passage from the second interior air passage in the air hub. The bifurcated compressed air port, when hooked up to a compressed air supply, would supply one half of the compressed air to the first interior air passage of the front ring of the air hub, and one half of the compressed air to the second interior air passage of the rear ring of the air hub.

The external sidewall of the air hub has four air vanes attached thereto.

A first pair of two air vanes are mounted on the front portion of the of the air hub and are in communication with the first interior air passage of the front ring.

A second pair of two air vanes are mounted on the rear portion of the air hub and have are in communication with the second interior air passage of the rear ring.

The first pair of two air vanes are located at the 12:00 position and the 6:00 position of the front portion of the air hub.

The first air vane located at the 12:00 position has an interior air passageway which passes through the sidewall of the front portion of the air hub and allows air to flow there-through from the first interior air passage of the front portion of the air hub.

The second air vane located at the 6:00 position has an interior air passageway which passes through the sidewall of the front portion of the air hub and allows air to flow there-through from the first interior air passage of the front portion of the air hub.

The second pair of two air vanes are located at the 9:00 and 3:00 position of the rear portion of the air hub.

The third air vane located at the 9:00 position has an interior air passageway which passes through the sidewall of the rear portion of the air hub and allows air to flow there-through from the second interior air passage of the rear portion of the air hub.

The fourth air vane located at the 3:00 position has an interior air passageway which passes through the sidewall of the rear portion of the air hub and allows air to flow there-through from the second interior air passage of the rear portion of the air hub.

The vanes that are located at the 12:00 position and the 6:00 position are longer than the vanes located at the 9:00 position and the 3:00 position.

At the distal end of all 4 vanes, the vanes are canted or angled in a forward fashion toward the workpiece. The canted or angled portion of each of the vanes includes an interior air passage as well. At the extreme end of the canted or angled element the air passageways include an end piece and each end piece includes a plurality of compressed air exit holes. The plurality of exit holes allow the secondary compressed air flow from the bifurcated input port to pass through the air hub, into the four vanes, and then into the canted or angled portion of the four vanes where it would exit through the plurality of exit holes located at the end of each vane.

The plurality of apertures located at the secondary compressed air exit aims the secondary compressed air flow into the spray pattern of atomized coating particles traveling toward the workpiece, thus adding a boost of energy to the spray pattern. The boost of energy when added to the spray pattern encourages the atomized coating particles to hit and adhere to the workpiece. Additionally, the secondary compressed air flow leaving the attachment or an atomizing air device creates a second directional flow pattern which peripherally surrounds the first pattern formed by the spray device, which additionally corrals the atomized particles back into the first spray pattern. Further, the secondary compressed air flow from the attachment (the invention) will cause induction of atmospheric air into the first spray pattern as well.

Other structural elements and additional embodiments of the invention will be introduced and discussed in the Detailed Description of the Figures.

DETAILED DESCRIPTION OF THE FIGURES

Figure 1:
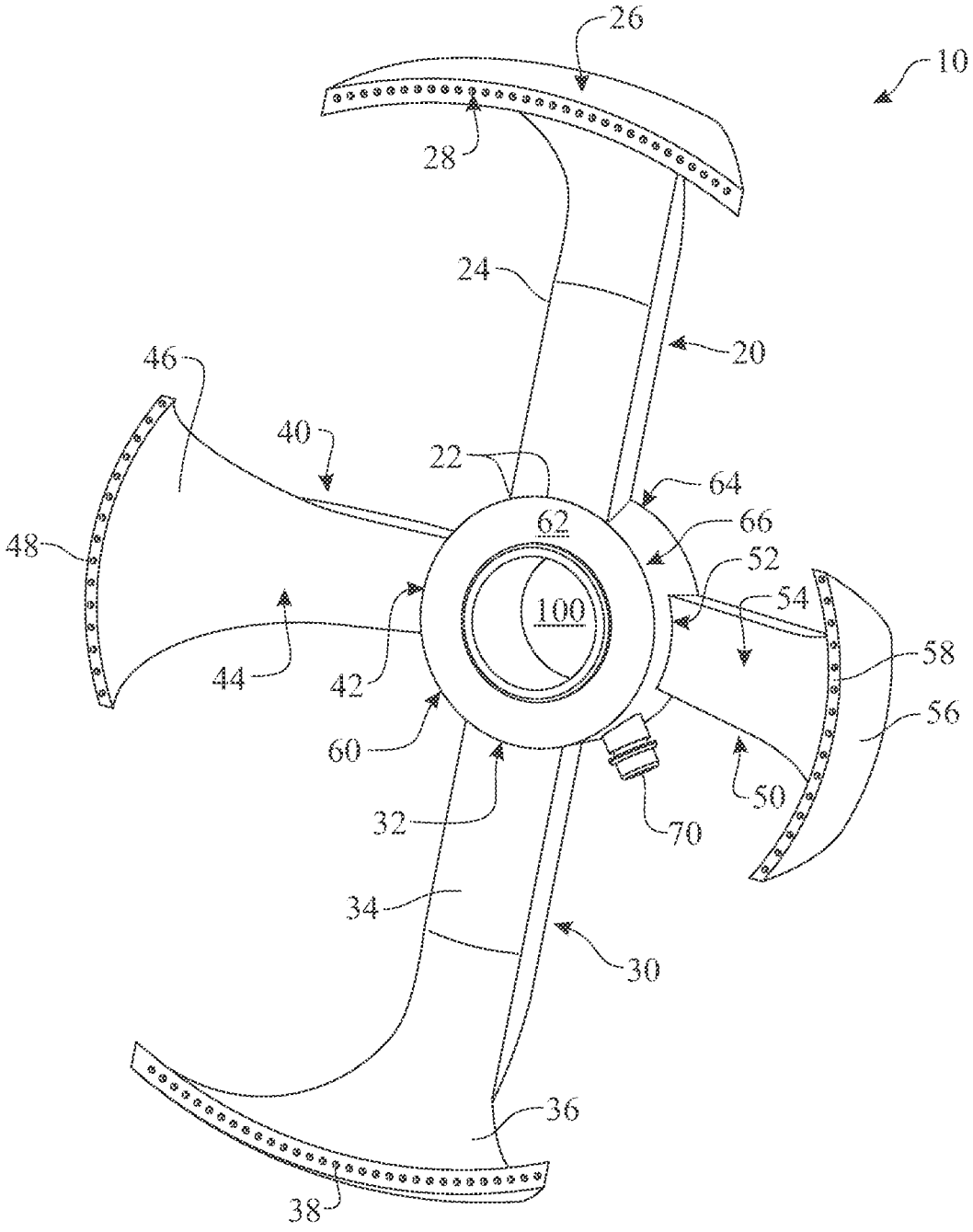
FIG. 1 is a perspective view of the spray device attachment of the invention.

Referring now specifically to FIGS. 1-3 and 14, the invention, which is the attachment to be employed with an atomizing spray device is shown.

An air hub 60 is provided with a front section 62 and a rear section 64. Through the center of the air hub 60 is a central aperture 100 which passes through both the front section 62 and the rear section 64. The central aperture 100 is designed to receive the front spray portion 5A of an atomizing spray device 5 therethrough (best seen in FIG. 10).

Depending from the air hub 60 are four vanes, 2 (two) connected through the front portion 62 of the sidewall 66 and 2 connected through the rear portion 64 of the sidewall 66.

The first vane 20 is connected through the front portion 62 of the air hub 60 sidewall 66. The first vane 20 is connected though the front portion 62 of the air hub 60 at the 12:00 position 22. At the 12:00 position 22 there is an opening from the front portion 62 of the air hub 60 sidewall 66 which engages an interior air passageway 80 (best seen in FIG. 2B) of the first vane 20.

The second vane 30 is connected through the front portion 62 of the air hub sidewall 66. The second vane 30 is connected though the front portion 62 of the air hub 60 at the 6:00 position 32.

The third vane 40 is connected through the rear portion 64 of the air hub 60 sidewall 66. The third vane 40 is connected though the rear portion 64 of the air hub 60 at the 9:00 position 42.

The fourth vane 50 is connected through the rear portion 64 of the air hub 60 sidewall 66. The fourth vane 50 is connected though the rear portion 64 of the air hub 60 at the 3:00 position 52.

In the preferred embodiment, the first vane 20 and the second vane 30 are identical in length and geometry. The third vane 40 and the fourth vane 50 are identical in length and geometry.

It has been contemplated that other embodiments can have different length vanes and different geometries and these are considered to be within the scope of the invention.

Between the second vane 30 and the fourth vane 50 is a bifurcated compressed air input port 70 which passes through the air hub sidewall 66. Inside the air hub 60 is an internal dividing wall 65 (best seen in FIG. 2C) which divides the air hub internally in two sections which makes a front air hub air passage 67 and a rear air hub air passage 68 (best seen in FIG. 2C).

Figure 7:
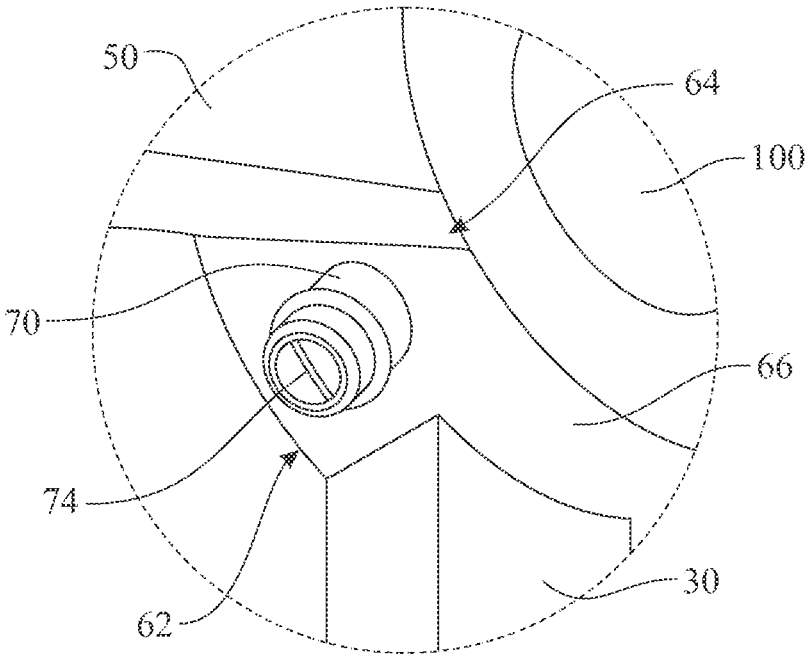
FIG. 7 is a partial exploded view of the bifurcated compressed air input port, taken from the broken circular region of FIG. 6.

The bifurcated compressed air input port 70 has a dividing element 74 best seen in FIG. 7. The bifurcated compressed air input port 70 passes through the air hub 60 in such a fashion that the dividing element 74 contacts the internal dividing wall 65 of the air hub 60 in a planar fashion. By this arrangement, when the compressed air enters the input port 70 it is divided into two air flows, one which enters the front air hub passage 67 and one that enters the rear air hub passage 68. It shows the internal front air hub passageway 67 which is adapted to receive both the 12:00 vane 20 and the 6:00 vane 30 in a continuous air conduit. It further shows the internal rear air hub passageway which is adapted to receive the 9:00 vane 40 and the 3:00 vane 50 in a second continuous air conduit.

The first vane 20 extends radially from the air hub 60 at position 22 through to a first vane middle portion 24. The first vane 20 extends radially from the air hub 60 at the 12:00 position. At the distal end of the first vane middle portion 24 is the first vane terminal portion 26. The first vane terminal portion 26 is angled or canted toward the workpiece. The first vane terminal portion 26 includes a plurality of apertures 28. The compressed air would enter the bifurcated compressed air input port 70 to the air hub 60 where half of the compressed air would travel in the air passageway inside the front portion 62 of the air hub 60 until it reaches the first vane 20 at position 22. The compressed air then proceeds inside of the first vane 20 (12:00 vane) along the interior air passageway 80 where it proceeds into the first vane terminal portion 26. The plurality of apertures 28 are in communication with the interior air passageway 80 of the first vane 20. The plurality of apertures 28 permit the compressed or soft air to exit the first vane 20 of the atomizing spray device attachment 10 and enter the pattern formed by atomizing spray device 5 (device 5 shown in FIG. 4 and pattern formed by device 5 shown in FIGS. 10 and 11). This has the effect of boosting the air pattern, placing more of the material being sprayed by the atomizing device 5 to reach and adhere to the target or workpiece. Additionally, these apertures 28, due to the pressure of the compressed air moving through them, will cause atmospheric air proximal to the apertures 28 to be inducted into the compressed air flow exiting the apertures 28.

The second vane 30 extends radially from the air hub 60 at position 32 through to a second vane middle portion 34. The second vane 20 extends radially from the air hub 60 at the 6:00 position. At the distal end of the second vane middle portion 34 is the second vane terminal portion 36. The second vane terminal portion 36 is angled or canted toward the workpiece. The second vane terminal portion 36 includes a plurality of apertures 38. The compressed air would enter the bifurcated compressed air input port 70 to the air hub 60 where half of the compressed air would travel in the air passageway inside the front portion 62 of the air hub 60 until it reaches the second vane 30 at position 32. The compressed air then proceeds inside of the second vane 30 (6:00 vane) along the interior air passageway 80 (the first vane 20 and the second vane 30 have identical interior compressed air passages) where it proceeds into the second vane terminal portion 36. The plurality of apertures 38 are in communication with the interior air passageway 80 of the second vane 30. The plurality of apertures 38 permit the compressed or soft air to exit the second vane 30 of the atomizing spray device attachment 10 and enter the pattern formed by atomizing spray device 5 (device 5 shown in FIG. 4 and pattern formed by device 5 shown in FIGS. 10 and 11). This has the effect of boosting the air pattern, placing more of the material being sprayed by the atomizing device 5 to reach and adhere to the target or workpiece. Additionally, these apertures 38, due to the pressure of the compressed air moving through them, will cause atmospheric air proximal to the apertures 38 to be inducted into the compressed air flow exiting the apertures 38.

The third vane 40 extends radially from the air hub 60 at position 42 through to a second vane middle portion 44. The third vane 40 extends radially from the air hub 60 at the 9:00 position and in this embodiment the length of the third vane 40 is less than the first vane 20 and the second vane 30. At the distal end of the third vane middle portion 44 is the third vane terminal portion 46. The third vane terminal portion 46 is angled or canted toward the workpiece. The third vane terminal portion 46 includes a plurality of apertures 48. The compressed air would enter the bifurcated compressed air input port 70 to the air hub 60 where half of the compressed air would travel in the air passageway inside the rear portion 62 of the air hub 60 until it reaches the third vane 40 at position 42. The compressed air then proceeds inside of the third vane 40 (9:00 vane) along the interior air passageway 82 where it proceeds into the third vane terminal portion 46. The plurality of apertures 48 are in communication with the interior air passageway 80 of the third vane 40. The plurality of apertures 48 permit the compressed or soft air to exit the second vane 30 of the atomizing spray device attachment 10 and enter the pattern formed by atomizing spray device 5 (device 5 shown in FIG. 4 and pattern formed by device 5 shown in FIGS. 10 and 11). This has the effect of boosting the air pattern, placing more of the material being sprayed by the atomizing device 5 to reach and adhere to the target or workpiece. Additionally, these apertures 48, due to the pressure of the compressed air moving through them, will cause atmospheric air proximal to the apertures 48 to be inducted into the compressed air flow exiting the apertures 48.

The fourth vane 50 extends radially from the air hub 60 at position 52 through to a fourth vane middle portion 54. The fourth vane 50 extends radially from the air hub 60 at the 3:00 position and in this embodiment the length of the fourth vane 50 is less than the first vane 20 and the second vane 30. At the distal end of the fourth vane middle portion 54 is the fourth vane terminal portion 56. The fourth vane terminal portion 56 is angled or canted toward the workpiece. The fourth vane terminal portion 56 includes a plurality of apertures 58.

The compressed air would enter the bifurcated compressed air input port 70 to the air hub 60 where half of the compressed air would travel in the air passageway inside the rear portion 62 of the air hub 60 until it reaches the fourth vane 50 at position 52. The compressed air then proceeds inside of the fourth vane 50 (3:00 vane) along the interior air passageway 82 (the third vane 40 and the fourth vane 50 have identical interior compressed air passages or conduits) where it proceeds into the fourth vane terminal portion 56. The plurality of apertures 58 are in communication with the interior air passageway 82 of the fourth vane 50. The plurality of apertures 58 permit the compressed or soft air to exit the fourth vane 50 of the atomizing spray device attachment 10 and enter the pattern formed by atomizing spray device 5 (device 5 shown in FIG. 4 and pattern formed by device 5 shown in FIGS. 10 and 11). This has the effect of boosting the air pattern, placing more of the material being sprayed by the atomizing device 5 to reach and adhere to the target or workpiece. Additionally, these apertures 58, due to the pressure of the compressed air moving through them, will cause atmospheric air proximal to the apertures 58 to be inducted into the compressed air flow exiting the apertures 58.

Figure 2B:
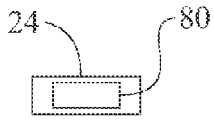
FIG. 2B is a cut-away view of the spray device attachment of the invention taken along line 2B-2B of FIG. 2.
Figure 2A:
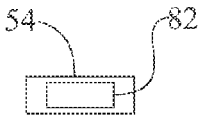
FIG. 2A is a cut-away view of the spray device attachment of the invention taken along line 2A-2A of FIG. 2.
Figure 2:
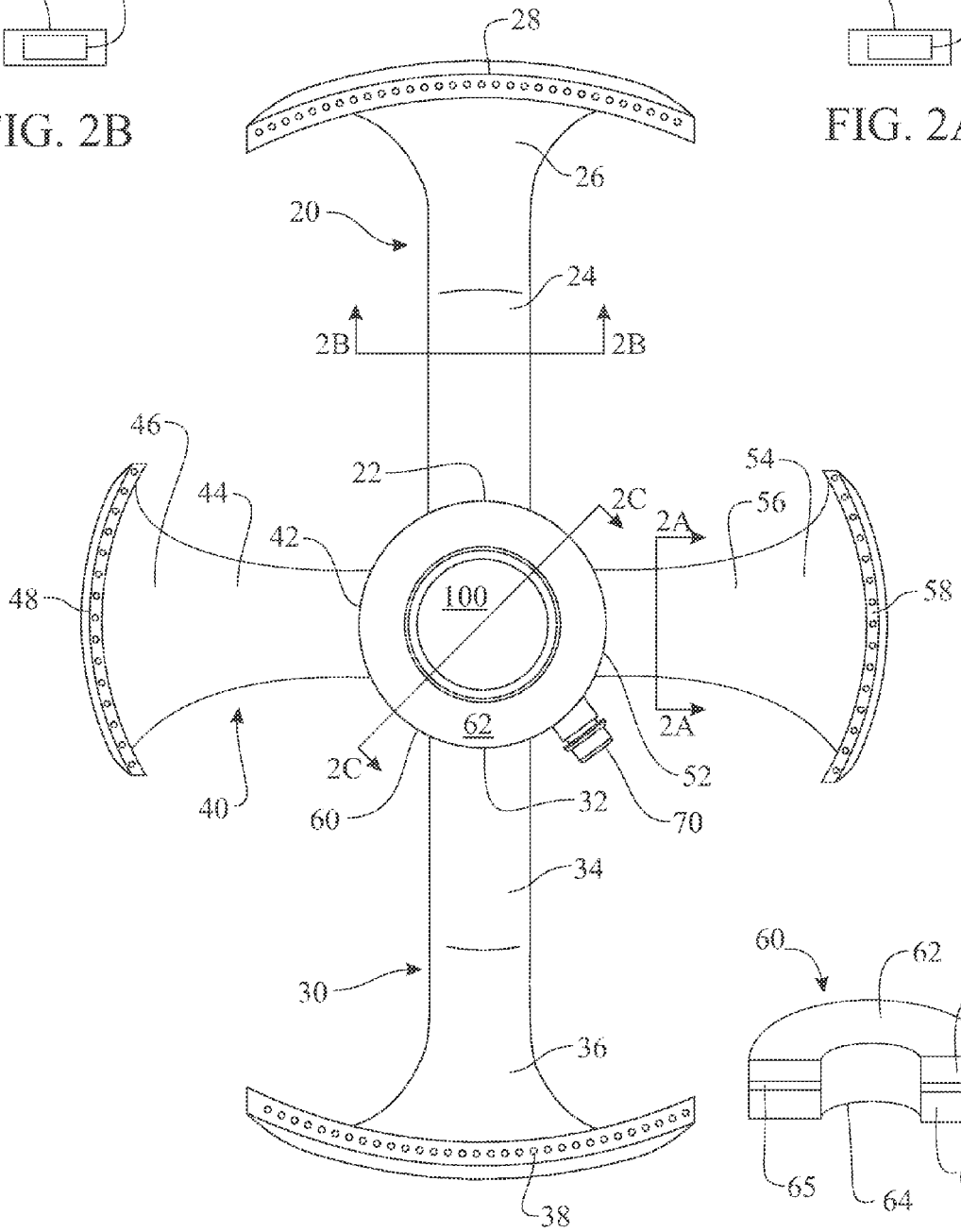
FIG. 2 is a front view of the spray device attachment of the invention.

FIG. 2A is a cut-away view of the spray device attachment of the invention taken along line 2A-2A of FIG. 2. The view taken along 2A-2A of the fourth vane 50 is identical to the view if such a cut away way made on the third vane 40. FIG. 2A shows the central air passageway 82 which connects to the rear portion 64 of the air hub 60 and extends to the to of the fourth or 3:00 vane 50 where the passageway 82 ends at a plurality of secondary compressed air exit apertures 58. Since the third vane 40 and the fourth vane 50 are identical, the air passageway 82 channel through the two vanes (40,50) are identical also.

FIG. 2B is a cut-away view of the spray device attachment of the invention taken along line 2B-2B of FIG. 2. The view taken along 2B-2B of the first vane 20 is identical to the view if such a cut away way made on the second vane 30. FIG. 2B shows the central air passageway 80 which connects to the front portion 62 of the air hub 60 and extends to the top of the first or 12:00 vane 20 where the passageway 80 ends at a plurality of secondary compressed air exit apertures 28.

Since the first vane 20 and the second vane 30 are identical, the air passageway (channel) 80 through the two vanes (20, 30) are identical also.

Figure 2C:
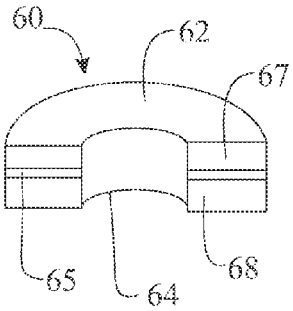
FIG. 2C is a cut-away view of the spray device attachment of the invention taken along line 2C-2C of FIG. 2.
Figure 3:
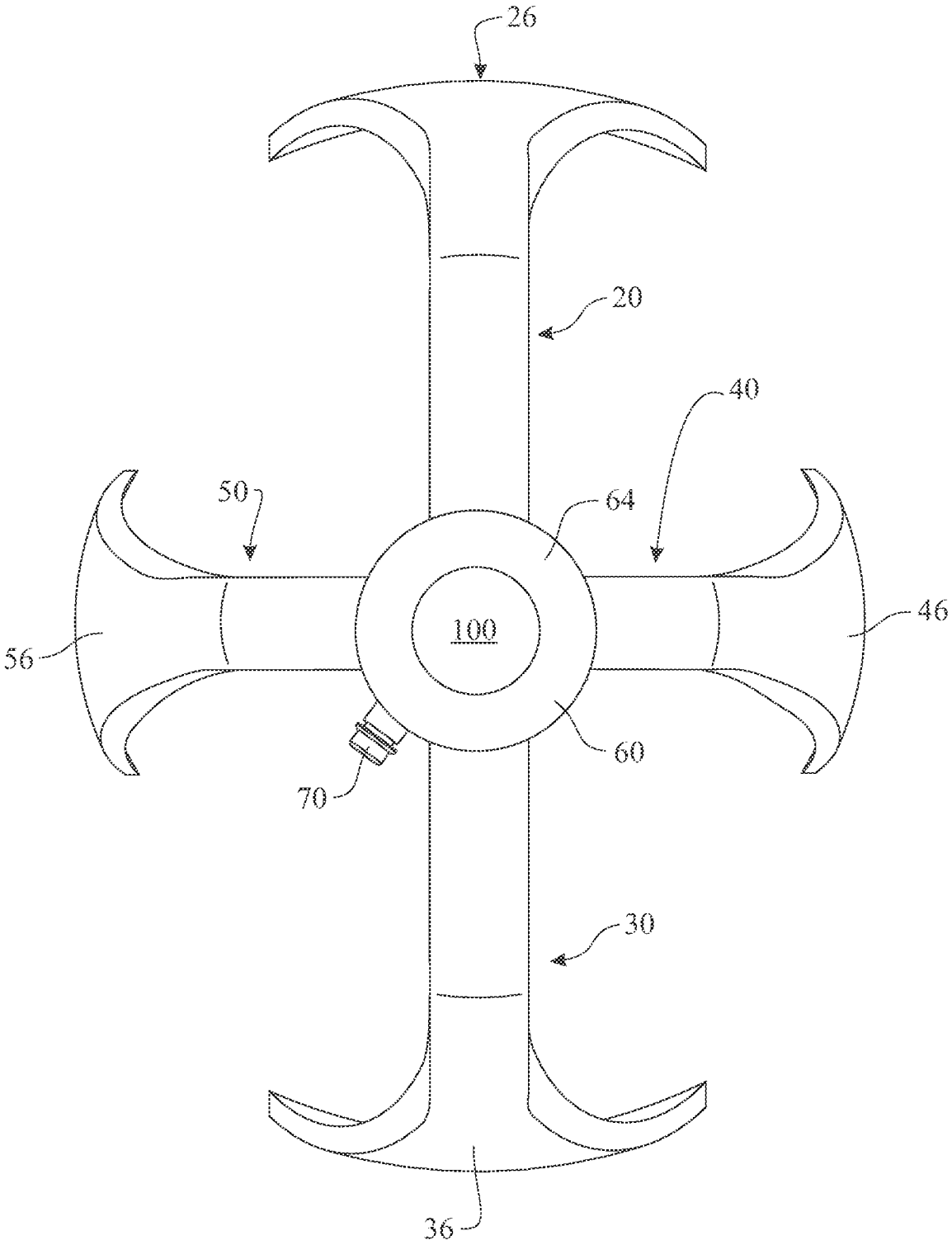
FIG. 3 is a rear view of the spray device attachment of the invention.

FIG. 2C is a cut-away view of the spray device attachment of the invention taken along line 2C-2C of FIG. 2. It shows the front portion 62 of the air hub 60 and the rear portion 64 of the air hub 60.

Figure 4:
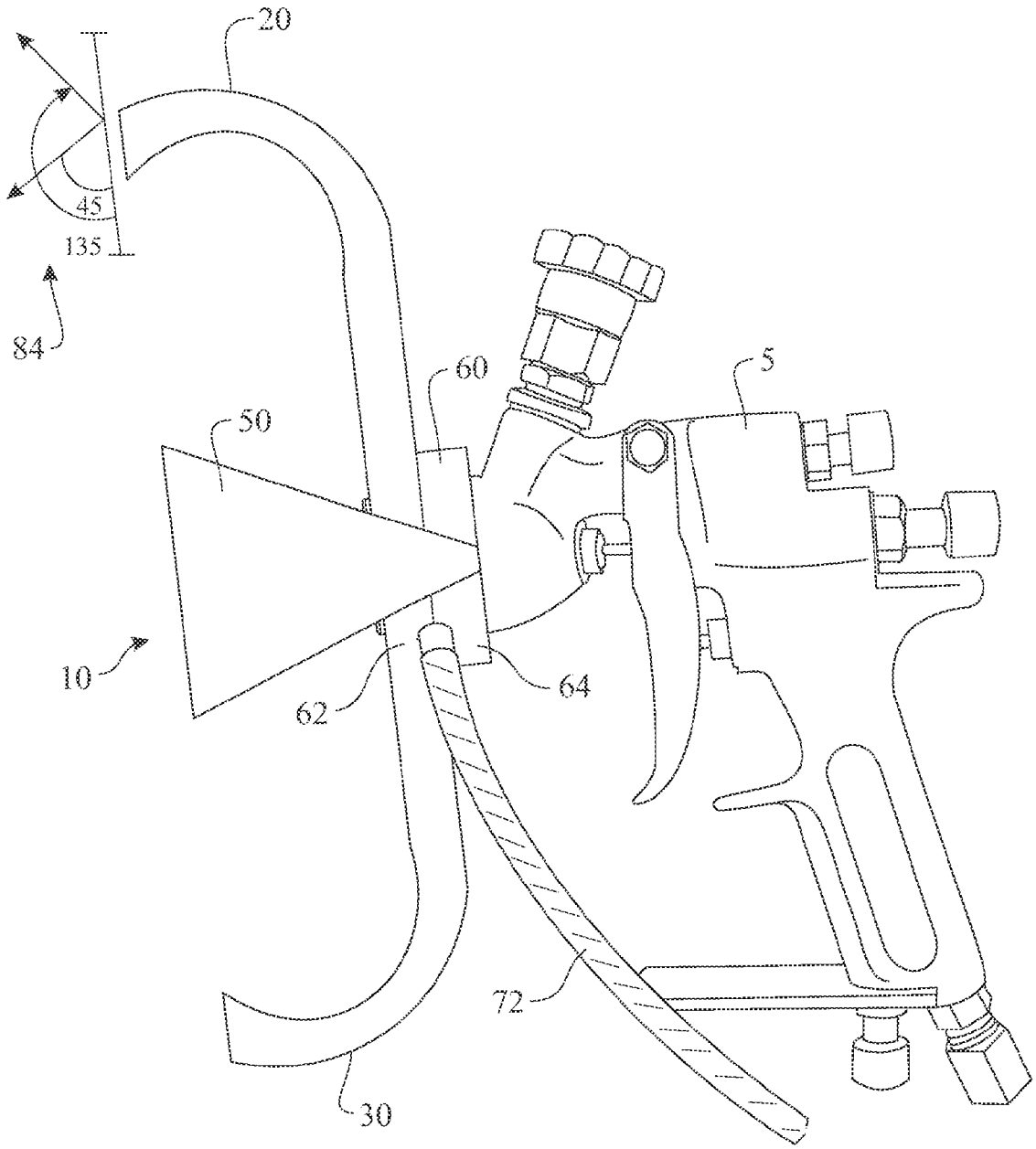
FIG. 4 is a side view of the spray device attachment of the invention, attached to a spray device.
Figure 5:
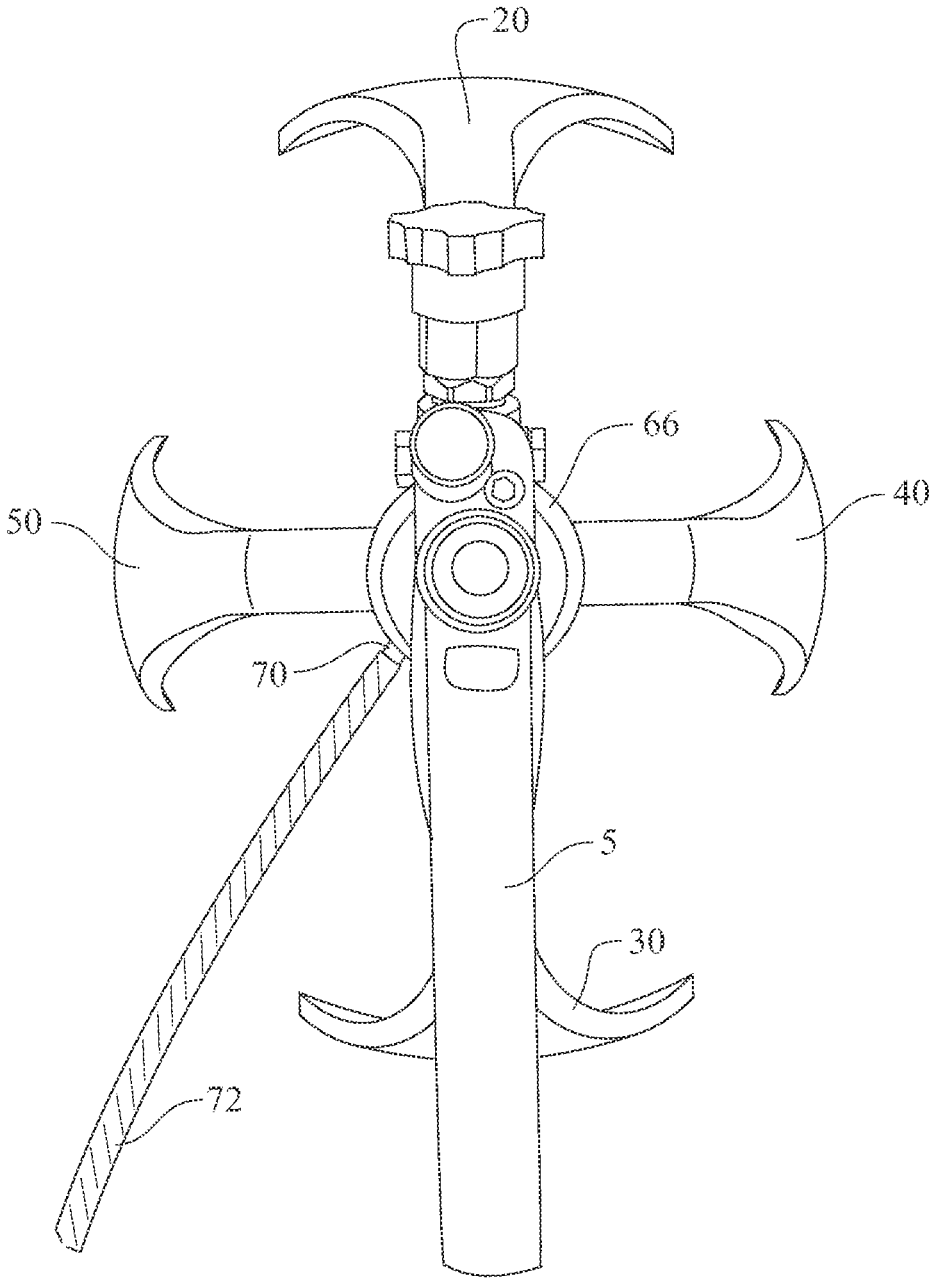
FIG. 5 is a rear view of the spray device attachment of the invention, also attached to a spray device.

Referring now to FIGS. 4 and 5 a view of the spray attachment 10 attached to a generic spray device 5 is shown. A compressed air line 72 is attached to the bifurcated compressed air port 70 which permits compressed air to enter the air hub 60. The front portion 62 of the air hub 60 receives the first half of the compressed air from the compressed air line 72, with the first half of the compressed air exiting the first (12:00) vane 20 and the second (6:00) vane 30. The rear portion 64 of the air hub 60 receives the second half of the compressed air form the compressed air line 72, with the second half of the compressed air exiting the third (9:00) vane 40 and the fourth (3:00) vane 50.

Figure 11:
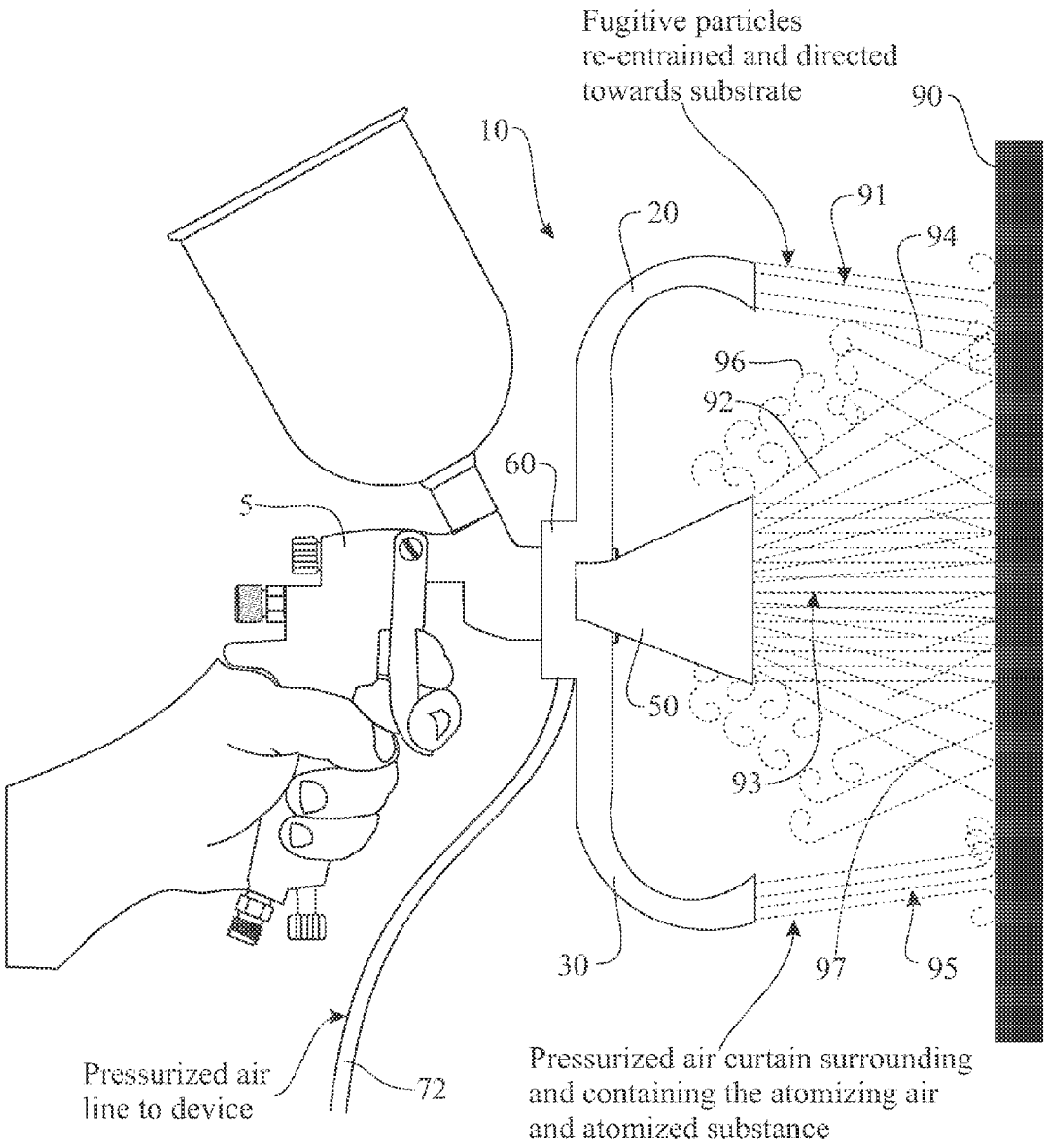
FIG. 11 is side view of a spray device spraying a workpiece with the spray device attachment being affixed to the spray device.

The terminal portion of all four vanes (26, 36, 46, 56) can be canted or angled in any of a range of angles so that the compressed air exiting from them can form a pattern which would boost or push the particles in the pattern exiting the spraying device 5 (see FIG. 11).

The number of degrees that the terminal portion of all four vanes (26, 36, 46, 56) would be canted or angled may be in a range from 45 degrees to 135 degrees from the mid-portion of each of the four vanes shown as pictograph 84 proximal vane 20 in FIG. 4. The angle shown in FIG. 4 is about 90 degrees from the portion of the vane that leaves the airhub 60. This angle would be chosen by the type of nozzle the spraying device 5 that the invention 10 is employed with. Once and angle is chosen for the terminal portion of all four vanes (26, 36, 46, 56) it would be set for that attachment 10. Other angles would be set for different spray devices.

Figure 6:
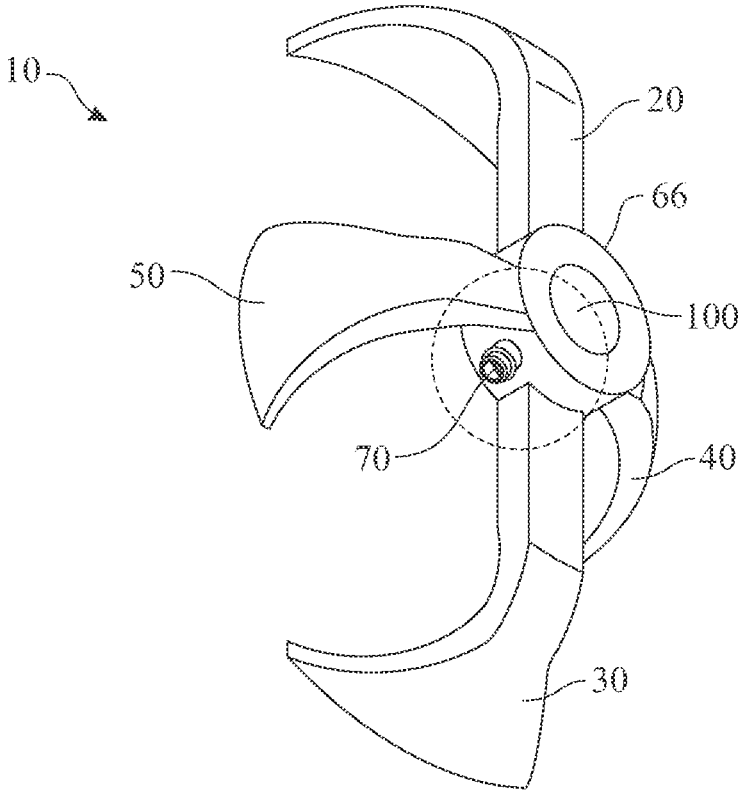
FIG. 6 is a view of the spray device attachment of the invention, with focus on the bifurcated compressed air input port.

Referring now to FIGS. 6 and 7 the spray device attachment 10 is shown with the central aperture 100 adapted to receive the front portion 5A of a spray device 5. Further the first vane 20, second vane 30, third vane 40 and fourth vane 50 are shown in FIG. 6.

In FIG. 7, an exploded view of the circular area in FIG. 6 is shown. Between the second vane 30 and the fourth vane 50 is the bifurcated compressed air port 70 shown on air hub 60. The bifurcated air compressed air port 70 has an interior dividing element 74 which divides the bifurcated air compressed air port 70 in half, which permits half the compressed air from the compressed air line 70 (when attached to the bifurcated air compressed air port 72) to enter the front air port internal air passage 67 and the other half to enter the rear air port internal air path 68.

Figure 8:
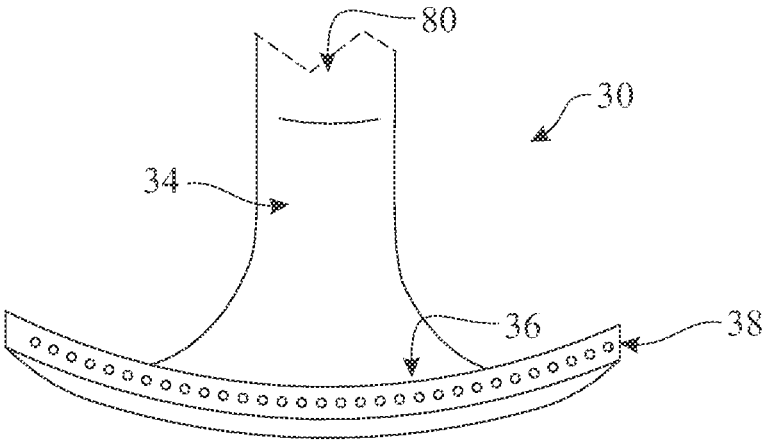
FIG. 8 is a partial close-up view of one of a pair of vanes of the spray device attachment of the invention, the partial close-up view of the vane being one of two identical vanes, one which is positioned at 12:00 and one which is positioned at 6:00.

FIG. 8 is a partial close-up view of one of a the pair of vanes positioned at the 12:00 and 6:00 position, either vane 20 or 30 as they are identical. Considering vane 30, the middle portion of the vane 34 and the canted or angled end portion 36 of the vane 30 is portrayed. At the end of the canted or angled portion 36 of the vane 30 is a plurality of exit apertures 38. Compressed air leaving the front internal air passage 67 enters the vane 30 air passage 80 where the air is then channeled through a connecting conduit centrally disposed interiorly of the canted or angled portion 36 of the vane 30 where the compressed air exits the vane 30 in a specific pattern created by the plurality of exit apertures 38.

Figure 9:
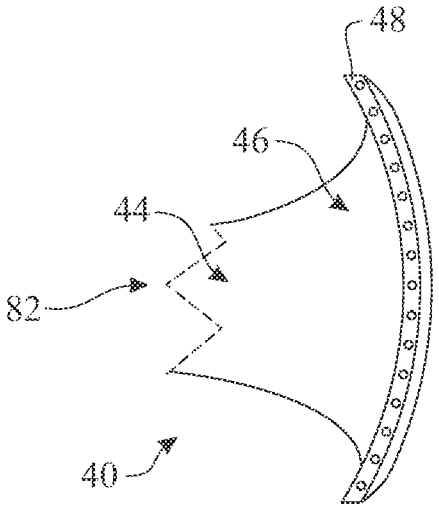
FIG. 9 is a partial close-up view of one of a pair of vanes of the spray device attachment of the invention, the partial close-up view of the vane being one of two identical vanes, one which is positioned at 9:00 and one which is positioned at 3:00.

FIG. 9 is a partial close-up view of one of a the pair of vanes positioned at the 3:00 and 9:00 position, either vane 40 or 50 as they are identical. Considering vane 40, the middle portion of the vane 44 and the canted or angled end portion 46 of the vane 40 is portrayed. At the end of the canted or angled portion 46 of the vane 40 is a plurality of exit apertures 48. Compressed air leaving the rear internal air passage 68 enters the vane 40 air passage 82 where the air is then channeled through a connecting conduit centrally disposed interiorly of the canted or angled portion 46 of the vane 40 where the compressed air exits the vane 40 in a specific pattern created by the plurality of exit apertures 48.

The specific pattern of compressed air created by the exit apertures 28, 38, 48 and 58 adds a boost of energy to the spray pattern leaving the front 5A of the spray device 5 pushing more of the spray particulates to the target workpiece. The specific pattern of compressed air created by the exit apertures 38, 38, 48 and 58 further forms an air barrier or peripheral air zone which corrals errant spray particulates and coerces these spray particulates to the target workpiece as well.

Figure 10:
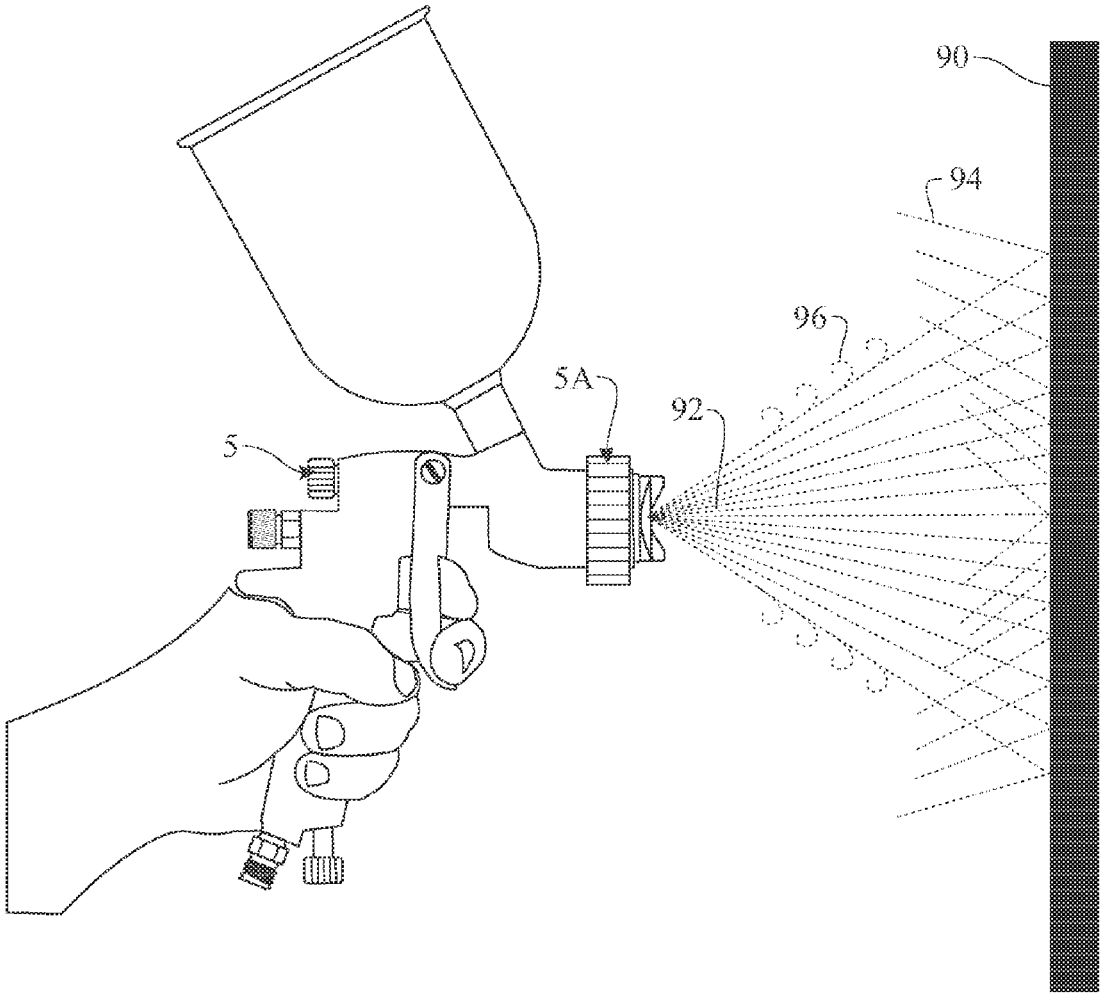
FIG. 10 is a side view of a spray device spraying a workpiece without the spray device attachment being attached to the spray device.

Referring specifically to FIG. 10, a spray device 5 is shown spraying a generic substance at a workpiece or target 90. The spray 92 from the spray device 5 leaves the nozzle and hits the workpiece 90. Some of the spray 92 will be retained on the workpiece 90; however, some of the spray 92 will not. The elements of the spray 92 that does not remain on the workpiece 90 includes bounce-back and overspray 94, and errant particles 96. The bounce-back/overspray 94 and errant particles 96 of the spray do not adhere to the workpiece/target 90 which reduces transfer efficiency. Spray 92 which either does not reach or does not adhere to the workpiece/target 90 is of concern for several reasons. This lost spray may not be environmentally friendly or biodegradable. The lost spray may emit fumes, and either the spray or the fumes may be toxic if inhaled or if it comes into contact with skin or the like. The lost spray could cause health problems with workers or animals which may inhale the spray. The lost spray may be blown by the wind into an agricultural area or may be chemical harmful to the atmosphere, ground, or water.

FIG. 11 shows the spray device 5 with the spray device attachment 10 attached. As previously discussed, the compressed air hose 72 brings compressed air into the bifurcated compressed air input port 70, into the air hub 60 where the compressed air is divided into the interior air passageways or conduits (80,82) present in the four vanes (20, 30, 40, 50). The compressed air exits the plurality of apertures (28,38,48,58) at the terminal end of each of the vanes (20, 30, 40, 50) and heads toward the workpiece in a compressed air pattern comprised of air jets 91 (from vane 20), air jet 93 (from vane 30), air jet 95 (from vane 40) and air jet 97 (from vane 50).

The spray pattern 92 from spray device 5 forms a pattern which is enclosed by the pattern from the air jets (91,93,95, 97) leaving the vanes of the invention 10. These air jets (91,93,95,97) adds an additional push or boost which causes more of the spray pattern 92 from the spray device 5 to hit and remain on the workpiece 90. This includes the spray 92 itself, the bounce-back/overspray 94 and the errant particles 96.

By causing more of the spray pattern 92 to remain on the workpiece 90 the transfer efficiency is thus increased.

Figure 12:
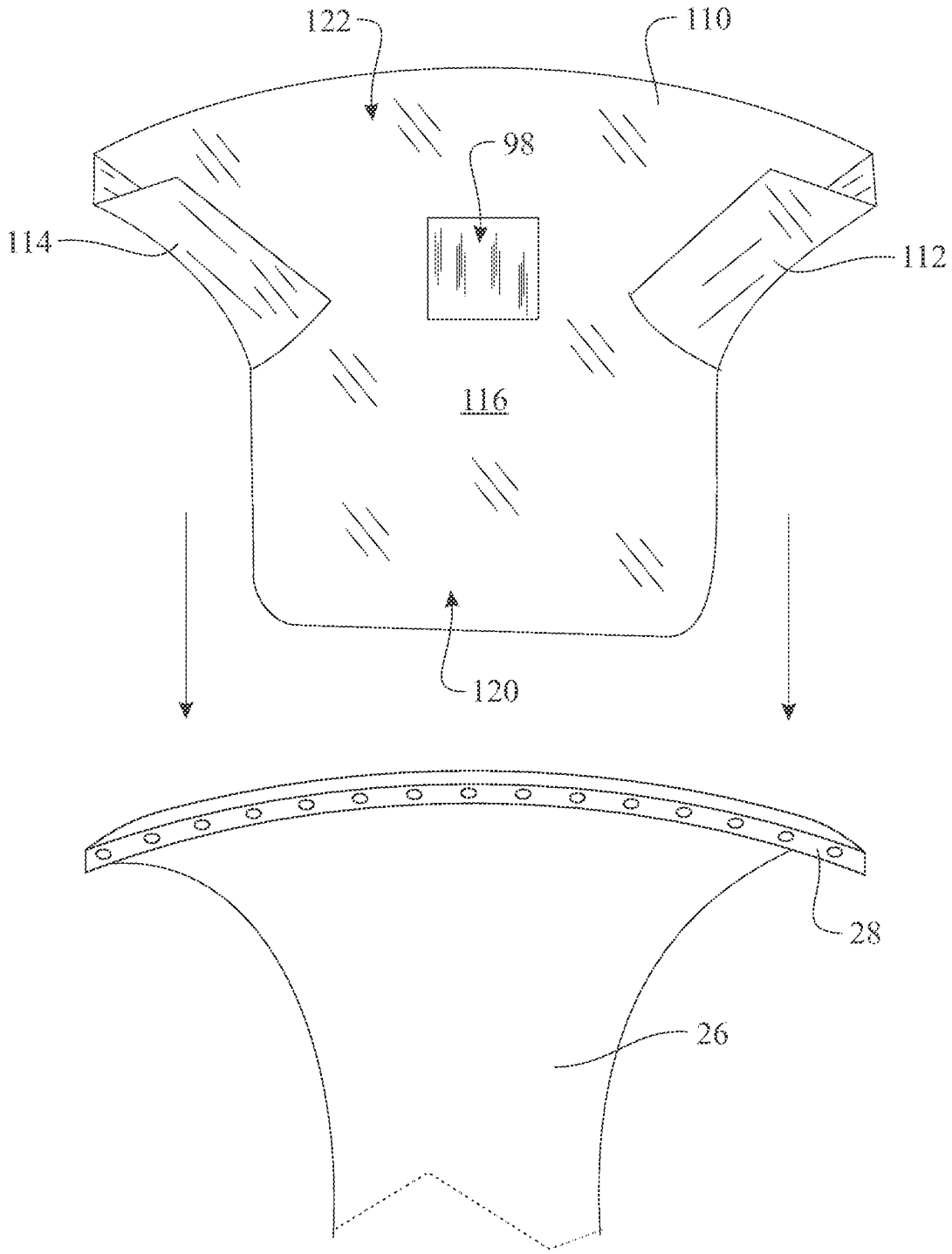
FIG. 12 is an exploded view of the vane attachment device, just prior to being placed on the vane, the vane attachment device permitting induction of atmospheric air to mix with the discharging compressed air leaving the apertures at the end of the vane.
Figure 13:
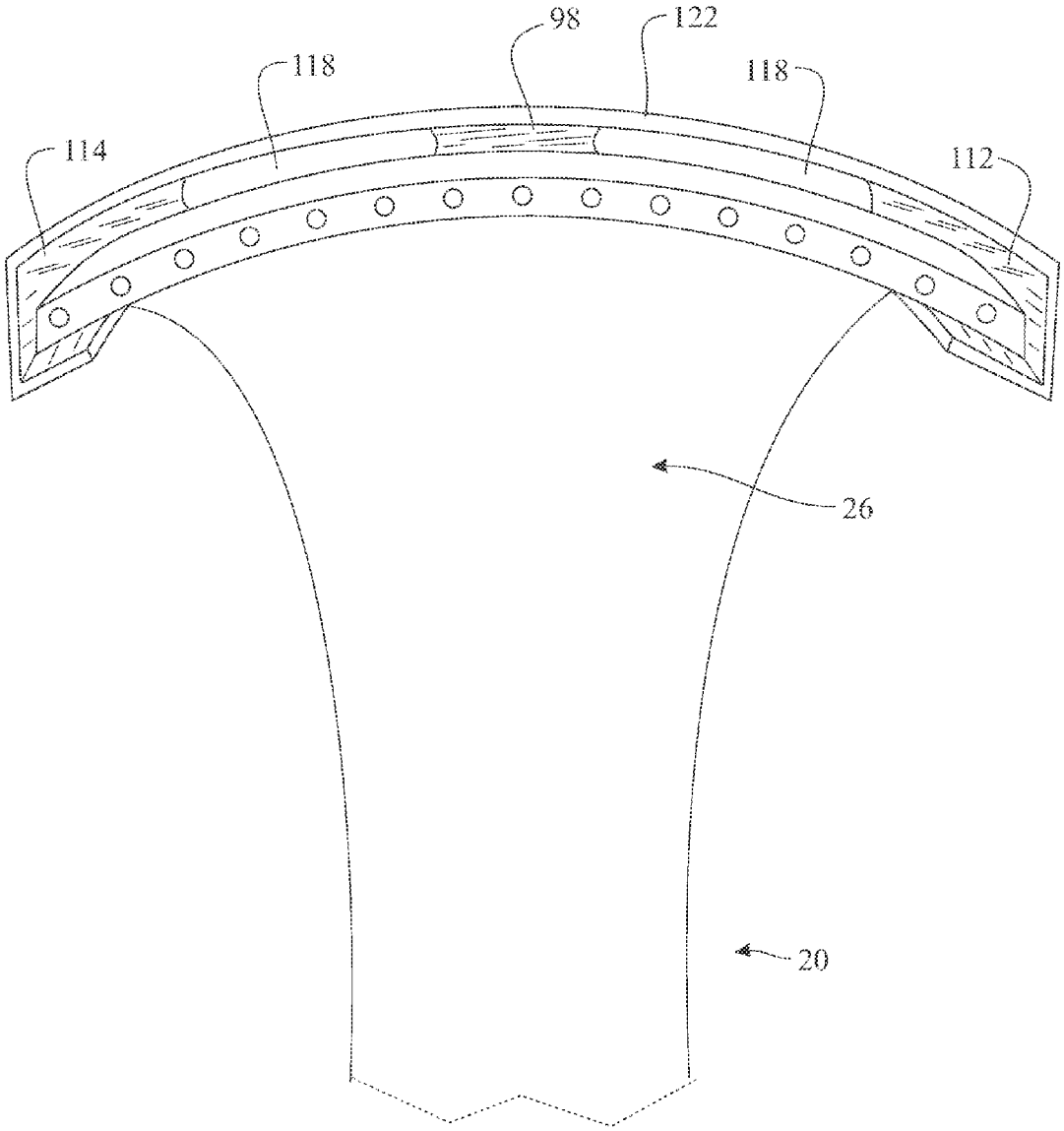
FIG. 13 is an exploded from view of a portion of the vane which the vane attachment device is attached to, the vane attachment device permitting induction of atmospheric air to mix with the discharging compressed air leaving the apertures at the end of the vane.

Referring now specifically to FIGS. 12-13, a first air induction sleeve 110 is provided to be attached over the canted or angled portion 26 of the first (12:00) vane 20. The first air induction sleeve 110 includes first attachment clip 112 and a second attachment clip 114. The first air induction sleeve 110 further includes a biasing element 98 centrally located on the interior 116 of the air induction sleeve 110.

When the air induction sleeve 110 is attached to the first vane terminal portion 26 (which is angled or canted toward the workpiece), the air induction sleeve 110 forms a pair of air conduits 118 intermediate the interior 116 of the air induction sleeve 110 and the exterior of the canted and angled portion 26 of the first vane 20. The compressed air which passes through the exit apertures 28 of the first vane 20 creates a low pressure zone at the exit apertures 28 of the vane 20, this low pressure zone pulls atmospheric air from the rear 120 of the air induction sleeve 110 through the air conduits 118 to the front of the air induction sleeve 110. The atmospheric air intermixes with the compressed air which exits from the exit apertures 28 of the first vane 20. This adds additional air to the specific pattern of compressed air which exits from the exit apertures 28.

Figure 14:
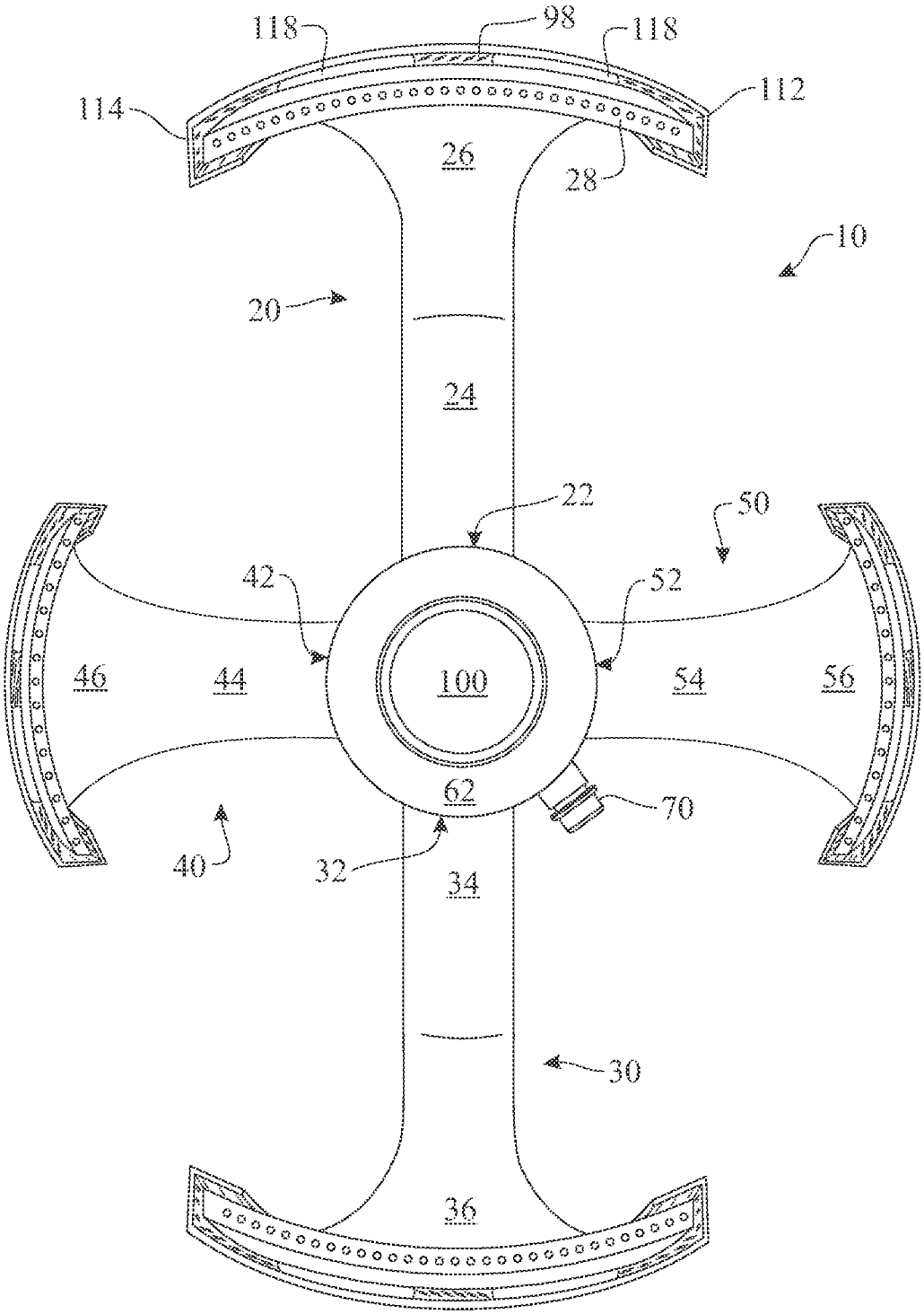
FIG. 14 is a front view of the spray device attachment, showing a vane attachment device affixed to each of the four vanes.

Referring now specifically to FIG. 14, the invention, which is the attachment 10 to be employed with an atomizing spray device 5 is shown with an air induction sleeve attached to the end of each of the four vanes 20, 30, 40, and 50. The elements of the attachment with the exception of the four air induction elements are discussed thoroughly in the description of FIGS. 1-3. The four air induction elements 110 are discussed thoroughly in the description of FIGS. 12-13.

The four air induction elements 110 may be manually attached to the distal portion of each vane or may be integral with the distal portion of each vane.

I claim:

1. An attachment to be secured about a spray exit portion of a spray device, said attachment comprising;

a cylindrical aperture adapted to receive the spray exit portion of the spray device, the spray exit portion discharging an atomizable spray toward a workpiece, an air hub surrounding said cylindrical aperture, said air hub including an outer sidewall and an interior air passageway, said airhub including a compressed air input port which passes through said air hub said outer sidewall into said interior air passageway, a first vane, said first vane having a first length, a proximal portion and a distal portion, said first vane including a first interior air conduit beginning at the proximal portion and terminating at the distal portion, said distal portion angled generally toward the workpiece, a second vane, said second vane having a first length, a proximal portion and a distal portion, said second vane including a second interior air conduit beginning at the proximal portion and terminating at the distal portion, said distal portion angled generally toward the workpiece, a third vane, said third vane having a second length, a proximal portion and a distal portion, said third vane including a third interior air conduit beginning at the proximal portion and terminating at the distal portion, said distal portion angled generally toward the workpiece, a fourth vane, said fourth vane having a second length, a proximal portion and a distal portion, said fourth vane including a fourth interior air conduit beginning at the proximal portion and terminating at the distal portion, said distal portion angled generally toward the workpiece, said first vane said proximal portion passes through said air hub said outer sidewall into said interior air passageway, said second vane said proximal portion passes through said air hub said outer sidewall into said interior air passageway 180 degrees from where said first vane passes through said air hub outer sidewall, said third vane said proximal portion passes through said air hub said outer sidewall into said interior air passageway 90 degrees to the right of where said first and second vane passes through the said air hub outer sidewall, said fourth vane said proximal portion passes through said air hub said outer sidewall into said interior air passageway 90 degrees to the left of where said first and second vane passes through the said air hub outer sidewall, and 180 degrees from where said third vane passes through said outer sidewall, a compressed air source connected to said compressed air input port, whereby when said spray exit portion of the spray device discharges an atomizable spray toward the workpiece forming a first spray device spray pattern, whilst contemporaneously compressed air is forced into the air hub, into said first air conduit, said second air conduit, said third air conduit, and said fourth air conduit where the compressed air exits said distal portion of said first vane, said second vane, said third vane, said fourth vane, forming a second pattern, said second pattern exerting propulsion and containment to said first pattern, causing a greater amount of the atomizable spray to adhere to the workpiece while reducing overspray, bounce-back and errant particles.

2. An attachment to be secured about the spray exit portion of a spray device, said attachment as claimed in claim 1 wherein said compressed air input port has an interior wall in said compressed air port, said wall being the length of the inner diameter of the compressed air port, said wall further being parallel to said air hub.

3. An attachment to be secured about the spray exit portion of a spray device, said attachment as claimed in claim 2 where said airhub has an interior wall, separating the airhub into a front portion and a rear portion, forming a front air passageway and a rear passageway.

4. An attachment to be secured about the spray exit portion of a spray device, said attachment as claimed in claim 3 wherein said compressed air input port interior wall is both coplanar and collinear with said airhub said interior wall, where ½ of the compressed air flows into the front portion of said airhub ant ½ of the compressed air flows to the rear portion of said airhub.

5. An attachment to be secured about the spray exit portion of a spray device, said attachment as claimed in claim 4 wherein said first vane proximal element passes through said airhub sidewall front portion.

6. An attachment to be secured about the spray exit portion of a spray device, said attachment as claimed in claim 5 wherein said second vane proximal element passes through said airhub sidewall front portion.

7. An attachment to be secured about the spray exit portion of a spray device, said attachment as claimed in claim 6 wherein said third vane proximal element passes through said airhub sidewall rear portion.

8. An attachment to be secured about the spray exit portion of a spray device, said attachment as claimed in claim 7 wherein said fourth vane proximal element passes through said airhub sidewall rear portion.

9. An attachment to be secured about the spray exit portion of a spray device, said attachment as claimed in claim 8 where said distal portion of said first vane includes a first plurality of apertures, said first plurality of apertures being in communication with said first air conduit and through said first plurality of apertures the compressed air exits the first vane forming a part of said second pattern.

10. An attachment to be secured about the spray exit portion of a spray device, said attachment as claimed in claim 9 where said distal portion of said second vane includes a second plurality of apertures, said second plurality of apertures being in communication with said second air conduit and through said second plurality of apertures the compressed air exits the second vane forming a part of said second pattern.

11. An attachment to be secured about the spray exit portion of a spray device, said attachment as claimed in claim 10 where said distal portion of said third vane includes a third plurality of apertures, said third plurality of apertures being in communication with said third air conduit and through said third plurality of apertures the compressed air exits the third vane forming a part of said second pattern.

12. An attachment to be secured about the spray exit portion of a spray device, said attachment as claimed in claim 11 where said distal portion of said fourth vane includes a fourth plurality of apertures, said fourth plurality of apertures being in communication with said fourth air conduit and through said fourth plurality of apertures the compressed air exits the fourth vane forming a part of said second pattern.

13. An attachment to be secured about the spray exit portion of a spray device, said attachment as claimed in claim 12 where said first plurality of apertures are equal in number to said second plurality of apertures.

14. An attachment to be secured about the spray exit portion of a spray device, said attachment as claimed in claim 13 where said third plurality of apertures are equal in number to said fourth plurality of apertures.

15. An attachment to be secured about the spray exit portion of a spray device, said attachment as claimed in claim 14, where said distal end of said first vane is adapted to receive a first air induction element thereon, secured about a right side of said distal end of said first vane and said left side of said distal end of said first vane, and further covers a top portion of said distal end of said first vane, said first air induction element including a first spacer intermediate a bottom side of said first air induction element and a top side of said distal end of said first vane, forming a first group of air induction passageways intermediate said bottom side of said first air induction element and said top side of said distal end of said first vane, whereby when said compressed air exits through said first plurality of apertures, a low pressure region is formed, inducting air through said first group of air induction pathways helping form said second pattern.

16. An attachment to be secured about the spray exit portion of a spray device, said attachment as claimed in claim 15, where said distal end of said second vane is adapted to receive a second air induction element thereon, secured about a right side of said distal end of said second vane and said left side of said distal end of said second vane, and further covers a top portion of said distal end of said second vane, said second air induction element including a second spacer intermediate a bottom side of said second air induction element and a top side of said distal end of said second vane, forming a second group of air induction passageways intermediate said bottom side of said second air induction element and said top side of said distal end of said second vane, whereby when said compressed air exits through said second plurality of apertures, a low pressure region is formed, inducting air through said second group of air induction pathways helping form said second pattern.

17. An attachment to be secured about the spray exit portion of a spray device, said attachment as claimed in claim 16, where said distal end of said third vane is adapted to receive a third air induction element thereon, secured about a right side of said distal end of said third vane and said left side of said distal end of said third vane, and further covers a top portion of said distal end of said third vane, said third air induction element including a third spacer intermediate a bottom side of said third air induction element and a top side of said distal end of said third vane, forming a third group of air induction passageways intermediate said bottom side of said third air induction element and said top side of said distal end of said third vane, whereby when said compressed air exits through said third plurality of apertures, a low pressure region is formed, inducting air through said third group of air induction pathways helping form said second pattern.

18. An attachment to be secured about the spray exit portion of a spray device, said attachment as claimed in claim 17, where said distal end of said fourth vane is adapted to receive a fourth air induction element thereon, secured about a right side of said distal end of said fourth vane and said left side of said distal end of said fourth vane, and further covers a top portion of said distal end of said fourth vane, said fourth air induction element including a fourth spacer intermediate a bottom side of said fourth air induction element and a top side of said distal end of said fourth vane, forming a fourth group of air induction passageways intermediate said bottom side of said fourth air induction element and said top side of said distal end of said fourth vane, whereby when said compressed air exits through said fourth plurality of apertures, a low pressure region is formed, inducting air through said fourth group of air induction pathways helping form said second pattern.

19. An attachment to be secured about the spray exit portion of a spray device, said attachment as claimed in claim 18 where both said length of said first vane and said length of said second vane may be selected, and the distal portion angle of said first vane and the distal angle of the second vane may be selected to optimize said second pattern in order to increase the transfer efficiency of the atomizable spray to the workpiece.

20. An attachment to be secured about the spray exit portion of a spray device, said attachment as claimed in claim 18 where both said length of said third vane and said length of said fourth vane may be selected, and the distal portion angle of said third vane and the distal angle of the fourth vane may be selected to optimize said second pattern in order to increase the transfer efficiency of the atomizable spray to the workpiece.

21. An attachment to be secured about the spray exit portion of a spray device, said attachment as claimed in claim 14 wherein said first plurality of apertures, said second plurality of apertures, said third plurality of apertures, and said fourth plurality of apertures may be chosen to have any number of apertures thereon in order to maximize effect the second pattern has on the energization of said first pattern.

22. An attachment to be secured about the spray exit portion of a spray device, said attachment as claimed in claim 18 wherein said first air induction element, said second air induction element, said third air induction element and said fourth air induction element are integral with each of said vanes.

* * * * *